US009978308B2

(12) United States Patent
Lin

(10) Patent No.: US 9,978,308 B2
(45) Date of Patent: May 22, 2018

(54) PIXEL VOLTAGE COMPENSATION CIRCUIT

(71) Applicant: AU Optronics Corporation, Hsin-Chu (TW)

(72) Inventor: Chen-Chi Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 51 days.

(21) Appl. No.: 15/083,322

(22) Filed: Mar. 29, 2016

(65) Prior Publication Data

US 2017/0148387 A1 May 25, 2017

(30) Foreign Application Priority Data

Nov. 25, 2015 (TW) ..... 104139266 A

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC combination set(s) only.
See application file for complete search history.

(56) References Cited

U.S. PATENT DOCUMENTS 7,825,880 B2 11/2010 Yumoto et al.
8,054,250 B2 11/2011 Kim
(Continued)

FOREIGN PATENT DOCUMENTS

CN 102346999 A 2/2012
CN 104409051 A 3/2015
(Continued)

OTHER PUBLICATIONS

Office Action issued in corresponding China patent application dated Aug. 2, 2017.

*Primary Examiner* — Van N Chow
(74) *Attorney, Agent, or Firm* — McClure, Qualey & Rodack, LLP

(57) ABSTRACT

A pixel voltage compensation circuit includes a first switch, a second switch, a driving switch, a third switch, a fourth switch, a first capacitor and a second capacitor. The first end of the first switch is coupled to a first node. The second end of the first switch is coupled to the data signal end. The first end of the second switch is coupled to the first node. The second end of the second switch is coupled to the anode end of the light emitting component. The first end of the driving switch is coupled to the high voltage source node. The first end of the third switch is coupled to the second end of the driving switch. The second end of the third switch is coupled to the light emitting component. The first end of the fourth switch is coupled to the control end of the driving switch. The second end of the fourth switch is coupled to the second end of the driving switch. The first capacitor is coupled to the control end of the driving switch and the first node. The second capacitor is coupled to the high voltage source node and the first capacitor.

17 Claims, 5 Drawing Sheets

(52) U.S. Cl.
CPC ..... *G09G 2300/0861* (2013.01); *G09G 2310/0262* (2013.01); *G09G 2320/043* (2013.01)

(56) References Cited

U.S. PATENT DOCUMENTS

| | | | | |
|---|---|---|---|---|
| 8,633,876 | B2 * | 1/2014 | Lee | G09G 3/3233 345/76 |
| 9,093,026 | B2 * | 7/2015 | Woo | G09G 3/3233 |
| 9,324,265 | B2 * | 4/2016 | Han | G09G 3/3233 |
| 9,697,771 | B2 * | 7/2017 | Azizi | G09G 3/3233 |
| 9,711,087 | B2 * | 7/2017 | Choi | G09G 3/3258 |
| 9,721,505 | B2 * | 8/2017 | Chaji | G06F 1/3218 |
| 2012/0026146 | A1 | 2/2012 | Kim | |
| 2016/0372030 | A1 | 12/2016 | Nagayama et al. | |

FOREIGN PATENT DOCUMENTS

| | | | |
|---|---|---|---|
| KR | 1020080080754 | | 9/2008 |
| TW | I252455 | B | 4/2006 |
| TW | 201610965 | A | 3/2016 |

* cited by examiner

PIXEL VOLTAGE COMPENSATION CIRCUIT

BACKGROUND

Technical Field

The present invention relates to a pixel voltage compensation circuit, and in particular, to a pixel voltage compensation circuit having a negative feedback path to improve electric leakage.

Related Art

During the operation process of a display, improper bias voltage or a change of another operation condition of a thin-film transistor (TFT) may cause, a parameter drift of the thin-film transistor component. Generally, to achieve better display performance, the characteristic drift of the thin-film transistor is compensated by using a pixel compensation circuit. The pixel compensation circuit generally includes several thin-film transistors and a storage capacitor.

In the current trend of increasingly higher resolution, more pixels must be set on a display panel. However, due to limited space on the panel, sizes of components in the pixel compensation circuit usually must be selectively reduced in order to accommodated more pixels. In one implementation, a size of the storage capacitor is reduced, to provide extra space to accommodate additional pixels. However, when the sized of the storage capacitor is reduced, an electric leakage problem of the thin-film transistor becomes more pronounced. Even worse, the foregoing problem affects pixel luminance, causing unevenness in a picture displayed on the display and therefore degrading a quality of the displayed picture.

SUMMARY

The present invention provides a pixel voltage compensation circuit, which not only can resolve a problem that a characteristic offset of a thin-film transistor affects a displayed picture but also overcomes a problem of display picture quality resulting from electric leakage of the thin-film transistor.

The present invention provides a pixel voltage compensation circuit, including a first switch, a second switch, a driving switch, a third switch, a fourth switch, a first capacitor, and a second capacitor. A first end of the first switch is coupled to a first node, and a second end of the first switch is coupled to a data signal end. A first end of the second switch is coupled to the first node, and a second end of the second switch is coupled to an anode end of a light emitting component. A first end of the driving switch is coupled to a high voltage source node high voltage source node. A first end of the third switch is coupled to a second end of the driving switch, and a second end of the third switch is coupled to the anode end of the light emitting component. A first end of the fourth switch is coupled to a control end of the driving switch, and a second end of the fourth switch is coupled to the second end of the driving switch. The first capacitor is coupled between the control end of the driving switch and the first node. The second capacitor is coupled to an end of the first capacitor. The first switch is configured to selectively turn on the data signal end and the first node according to a first control signal. The second switch is configured to selectively turn on the first node and the anode end of the light emitting component according to a control signal. The third switch is configured to selectively turn on the second end of the driving switch and the anode end of the light emitting component according to a light emitting control signal. The fourth switch is configured to selectively turn on the control end of the driving switch and the second end of the driving switch according to a second control signal.

In conclusion, in the pixel voltage compensation circuit provided by the present invention, a compensation voltage value is applied to a gate node of a driving switch, so that the driving switch is controlled only by a reference voltage and a data voltage at a light emitting stage. In this way, a current output by the driving switch at the light emitting stage is not affected by a voltage offset and therefore remains stable, and a light emitting component is driven by the stable current to emit light. In addition, the pixel voltage compensation circuit provided by the present invention also has a negative feedback path. Even if electric leakage occurs in a transistor in the circuit, a voltage value offset can be compensated in real time by using the negative feedback path, to avoid a problem that the electric leakage of the transistor causes distortion of a displayed picture.

The foregoing description about the content of the present disclosure and the following descriptions of implementation manners are used to illustrate and explain the spirit and principle of the present invention and provide further explanations of the patent application scope of the present invention.

DETAILED DESCRIPTION

The following implementation manners describe detailed characteristics and advantages of the present invention in detail. The content thereof is sufficient for any person skilled in the art to learn the technical content of the present invention and implement the present invention according to the technical content, and any person skilled in the art can readily learn a related objective and advantages of the present invention according to the content disclosed in this specification, the patent application scope, and the drawings. The following embodiments further describe ideas of the present invention, but the scope of the present invention is not limited to any of the ideas.

Figure 1:
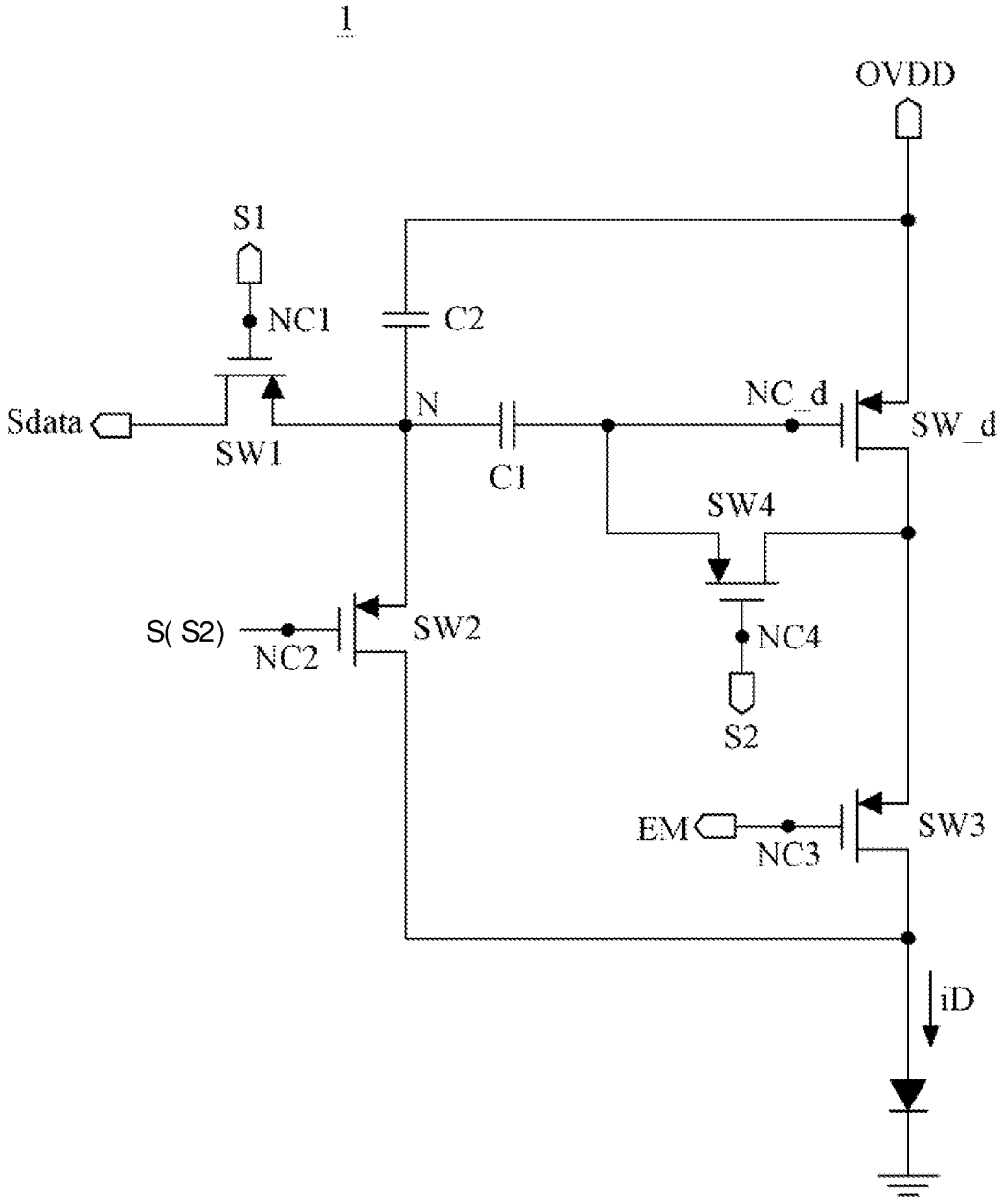
FIG. 1 is a schematic circuit diagram of a pixel voltage compensation circuit according to an embodiment of the present invention.

Referring to FIG. 1, FIG. 1 is a schematic circuit diagram of a pixel voltage compensation circuit according to an embodiment of the present invention. The pixel voltage compensation circuit 1 has switches SW1 to SW4, a driving switch SW_d, and capacitors C1 and C2. A first end of the switch SW1 is coupled to a node N, a second end of the switch SW1 is coupled to a data signal end to receive a data signal Sdata, and a control end NC1 of the switch SW1 receives a control signal S1. A first end of the switch SW2 is coupled to the first node, a second end of the switch SW2 is coupled to an anode end of a light emitting component, and a control end NC2 of the switch SW2 receives a control signal S. A first end of the driving switch SW_d is coupled to a high voltage source node to receive a high voltage level OVDD. A first end of the switch SW3 is coupled to a second end of the driving switch SW_d, a second end of the switch SW3 is coupled to the anode end of the light emitting component, and a control end NC3 of the switch SW3 receives a light emitting control signal EM. A first end of the switch SW4 is coupled to a control end of the driving switch SW_d, a second end of the switch SW4 is coupled to the second end of the driving switch SW_d, and a control end NC4 of the switch SW4 receives a control signal S2. In this embodiment of the present invention, the control signal S is the same as the control signal S2. The capacitor C1 is coupled between the control end NC_d of the driving switch SW_d and the node N. The capacitor C2 is coupled between the high voltage source node and an end of the capacitor C1, and the capacitor C2 receives a high voltage level OVDD from the high voltage source node. In the embodiment corresponding to FIG. 1, the capacitor C2 is coupled between the node N and the high voltage source node.

As used herein, the term "coupled" means either a direct electrical connection, or an electrical connection through one or more intermediary components which intermediary components don't have an appreciable impact on the electrical signal.

The switch SW1 is configured to selectively turn on the data signal end and the node N according to the control signal S1, to selectively increase a voltage level of the node N to a voltage level of the data signal Sdata. The switch SW2 is configured to selectively turn on the node N and the anode end of the light emitting component D according to the control signal S2. The switch SW3 is configured to selectively turn on the second end of the driving switch SW_d and the anode end of the light emitting component D according to the light emitting control signal EM. The switch SW4 is configured to selectively turn on the control end NC_d and the second end of the driving switch SW_d according to the control signal S2. In this embodiment, the switch SW1 to the switch SW4 and the driving switch SW_d are P-type thin-film transistors. However, in other embodiments, the switch SW1 to the switch SW4 and the driving switch SW_d may be N-type thin-film transistors or switch circuits formed by multiple thin-film transistors. The light emitting component D is, for example, an organic light-emitting diode (Organic Light-Emitting Diode, OLED). The foregoing implementation forms of the components are merely examples, and the present invention is not limited thereto.

Figure 2:
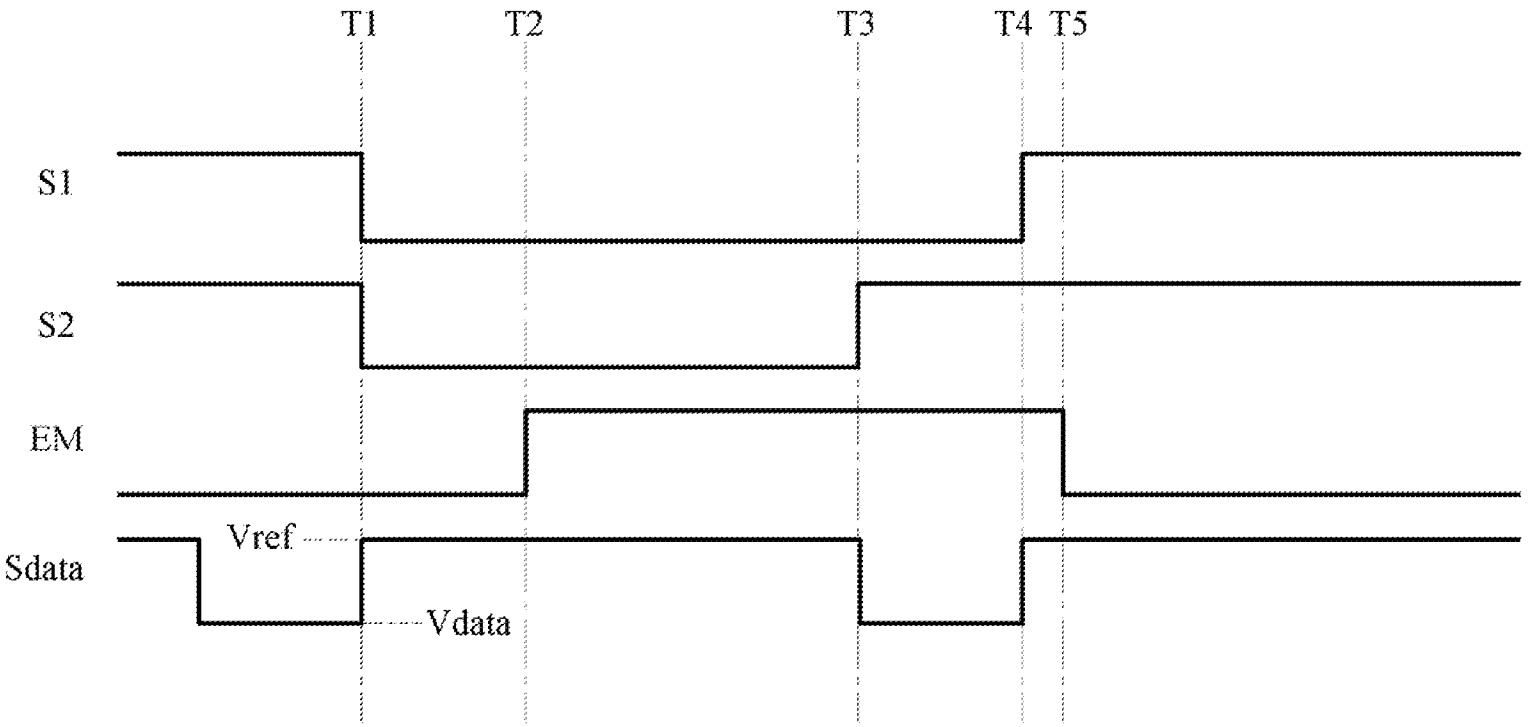
FIG. 2 is a schematic sequence diagram of a pixel voltage compensation circuit according to an embodiment of the present invention.

An operation of the pixel voltage compensation circuit is described with reference to FIG. 2. FIG. 2 is a schematic sequence diagram of a pixel voltage compensation circuit according to an embodiment of the present invention. FIG. 2 shows a relative time sequence, which is marked with time points T1 to T5, of the control signals S1 and S2, the light emitting control signal EM, and the data signal Sdata. The control signals S1 and S2 and the light emitting control signal EM are each switched between a high level and a low level. It should be noted that the figure is merely used for illustrative description and does not constitute a limitation on whether high levels and low levels of the control signals S1 and S2 and the light emitting control signal EM are the same.

Similarly, in FIG. 2, the data signal Sdata is selectively switched between a reference voltage level Vref and a data voltage level Vdata. In this embodiment, the switch SW1 to the switch SW4 and the driving switch SW_d are P-type thin-film transistors, and correspondingly, the reference voltage level Vref is higher than the data voltage level Vdata. However, relative values of the reference voltage level Vref and the data voltage level Vdata can be freely designed by a person of ordinary skill in the art according to an actual requirement, and are not limited to the foregoing example. Similarly, values of the reference voltage level Vref and the data voltage level Vdata relative to values of high levels and low levels of the control signals S1 and S2 and the light emitting control signal EM are not limited either.

In addition, in a conventional pixel voltage compensation circuit, even if a light emitting control signal is removed, at least three or four control signals are usually needed to drive the pixel voltage compensation circuit, resulting in a shortage of routing space. However, in the present invention, because the second end of the switch SW2 is coupled between the second end of the switch SW3 and the anode end of the light emitting unit D, after the light emitting control signal EM is removed from the pixel voltage compensation circuit 1, only the control signal S1 and the control signal S2 are needed to successfully drive the pixel voltage compensation circuit 1, which saves routing space compared with the prior art.

In the foregoing, a time period between the time point T1 and the time point T2 is defined as a reset stage. At the reset stage, the control signals S1 and S2 and the light emitting control signal EM are all at low levels, and the voltage level of the data signal Sdata is the reference voltage level Vref. In this case, the switches SW1 to SW4 are turned on. The voltage level of the node N and a voltage level of the control end NC_d are adjusted to the reference voltage level. In an embodiment, the reference voltage level Vref is adjusted according to characteristics of the components of the circuit, so that a voltage across the light emitting component D is not less than a turn-on voltage at the reset stage, and therefore, the light emitting component D does not emit light at the reset stage.

A time period between the time point T2 and the time point T3 is defined as a compensation stage. At the compensation stage, the control signals S1 and S2 are at low levels, the light emitting control signal EM is at a high level, and the voltage level of the data signal is the reference voltage level Vref. In this case, the switch SW1, the switch SW2, the switch SW4, and the driving switch SW_d are turned on, and the switch SW3 is not turned on. Correspondingly, a voltage level of the second end of the driving switch NC_d is a difference between the high voltage level OVDD and an absolute value of a turn-on voltage Vth_d of the driving switch NC_d. If briefly represented by labels, the foregoing difference is OVDD−|Vth_d|. Because the switch SW4 is turned on and the first end and the second end of the switch SW4 are in a floating (floating) state, in this case, voltage levels of the first end and the control end NC_d of the switch SW4 are also the difference between the high voltage level OVDD and the absolute value of the turn-on voltage Vth_d.

A time period between the time point T3 and the time point T4 is defined as a data writing stage. At the data writing stage, the control signal S1 is at a low level, the control signal S2 and the light emitting control signal EM are at high levels, and the voltage level of the data signal Sdata is the data voltage level Vdata. In this case, the switch SW1 and the driving switch SW_d are turned on, and the switches SW2 to SW4 are not turned on. Correspondingly, the voltage level of the node N is adjusted from the reference voltage level Vref to the data voltage level Vdata. Because of a capacitive coupling effect, the voltage level of the control end NC_d is collaterally adjusted to a sum of the difference between the high voltage level OVDD and the turn-on voltage Vth_d and a difference between the data voltage level Vdata and the reference voltage level Vref. If briefly represented by labels, the foregoing sum is OVDD−|Vth_d|+Vdata−Vref.

A time period between the time point T4 and the time point T5 is defined as a maintenance stage. At the maintenance stage, the control signals S1 and S2 and the light emitting control signal EM are all at high levels, and the voltage level of the data signal Sdata is the reference voltage level Vref. In this case, the driving switch SW_d is turned on, and the switches SW1 to SW4 are not turned on. In this case, the voltage level of the node N and the voltage level of the control end NC_d are maintained at the voltage levels that are at the data writing stage.

A time period after the time point T5 is defined as a light emitting stage, and an end time point of the light emitting stage is not limited herein. At the light emitting stage, the control signal S1 is at a high level, the control signal S2 is at a high level, the light emitting control signal EM is at a low level, and the voltage level of the data signal Sdata is the reference voltage level Vref. In this case, the driving switch SW_d is turned on, and the switch SW1, the switch SW2, the switch SW3, and the switch SW4 are not turned on. Correspondingly, the high voltage source node, the driving switch SW_d, the switch SW3, the light emitting component D, and a ground end form a current path. The driving switch SW_d generates a drive current iD according to the voltage level of the control end NC_d and the high voltage level OVDD, and the light emitting component D selectively emits light according to a value of the drive current iD.

In this embodiment, the voltage level of the control end NC_d at this time is the sum of the difference between the high voltage level OVDD and the turn-on voltage Vth_d and the difference between the data voltage level Vdata and the reference voltage level Vref. According to a turn-on current formula of a P-type thin film transistor, the value of the drive current iD may be presented as:

$$iD = \mu_d C_{OX_d}\left(\frac{W}{L}\right)_d (Vref - Vdata)^2.$$

The parameters $\mu_d$, $C_{OX_d}$, and $$\left(\frac{W}{L}\right)_d$$

are related to a thin-film transistor corresponding to the driving switch SW_d. $\mu_d$ is carrier mobility (carrier mobility), $C_{OX_d}$ is a value of capacitance per unit of a gate oxide layer, and $$\left(\frac{W}{L}\right)_d$$

is a ratio of a gate width to a gate length of the thin-film transistor corresponding to the driving switch SW_d. The reference voltage level Vref and the data voltage level Vdata are default voltage values, and therefore may be considered as constants. In this case, the drive current iD is related only to the foregoing constant parameters; therefore, the drive current iD is not affected by floating of a voltage level of each node, and is not affected by drifting of a turn-on voltage of each switch either. For example, the foregoing expression of the drive current iD does not include the turn-on voltage Vth_d; therefore, even if the turn-on voltage Vth_d drifts due to a bias voltage of the driving switch SW_d, the drive current iD is not affected. In other words, because the value of the drive current iD at the light emitting stage is related only to the constant parameters, the value of the drive current iD at the light emitting stage approaches a fixed value, and therefore, light emitted by the light emitting unit D remains stable.

At the light emitting stage, although the switch SW2 and the switch SW4 are not turned on, in the pixel voltage compensation circuit 1, a first leakage current path and a second leakage current path are formed respectively based on electric leakage characteristics of the switch SW2 and the switch SW4. The capacitor C2 discharges because of the second leakage current path formed by the switch SW4, and the voltage level of the control end NC_d of the driving switch SW_d therefore decreases. The capacitor C1 and the capacitor C2 charge because of the first leakage current path formed by the switch SW2, and the voltage level of the control end NC_d increases. In this way, the voltage level of the control end NC_d does not deviate due to a phenomenon of electric leakage of each switch, and therefore, the drive current iD can remain stable.

In fact, a time period after the time point T4 can also be defined as a light emitting stage. The definitions of the stages are merely used to facilitate this description, and actions of the pixel voltage compensation circuit 1 are described in the foregoing but are not limited to the foregoing description.

Figure 3:
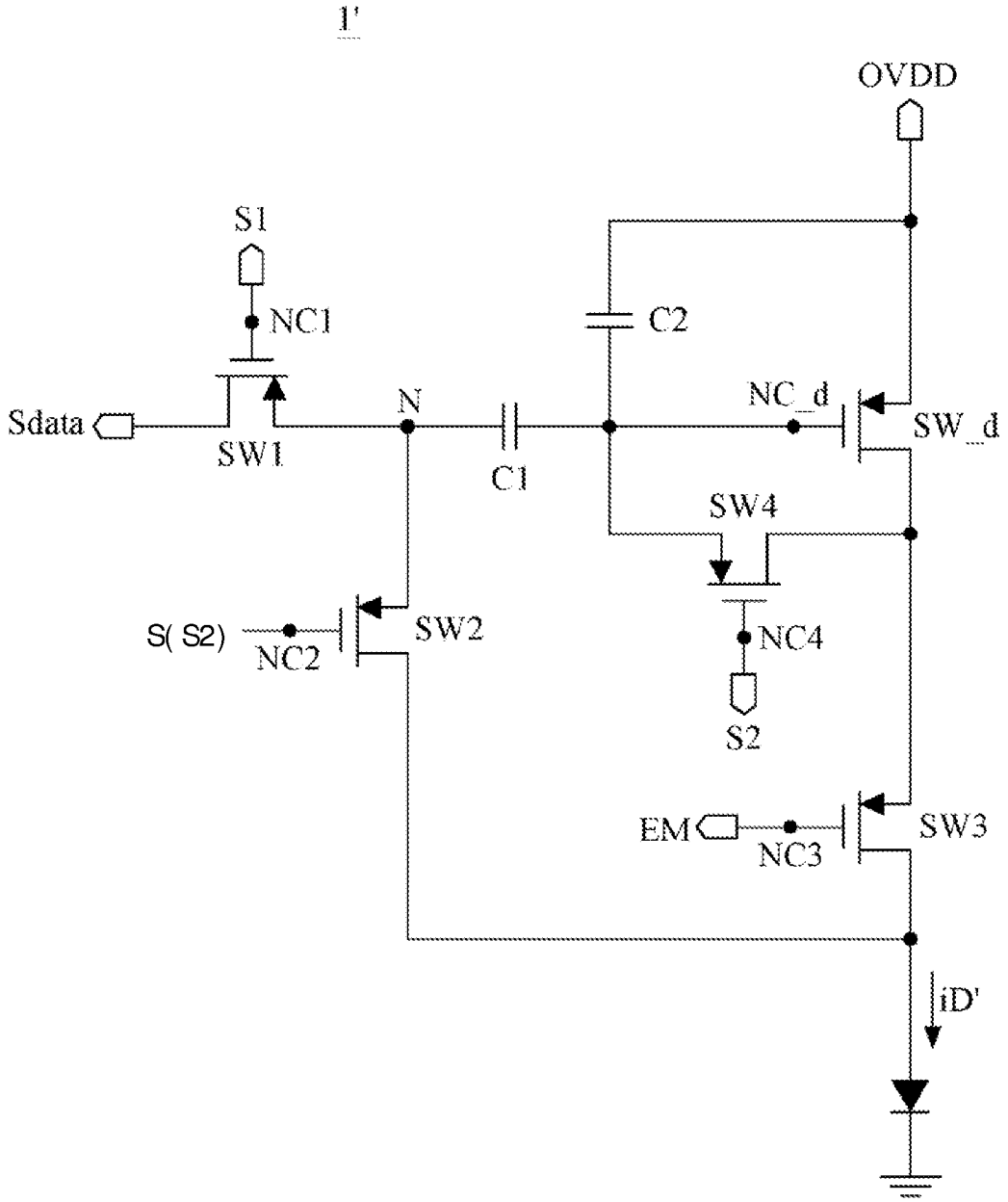
FIG. 3 is a schematic circuit diagram of a pixel voltage compensation circuit according to another embodiment of the present invention.

Further referring to FIG. 3, FIG. 3 is a schematic circuit diagram of a pixel voltage compensation circuit according to another embodiment of the present invention. In this embodiment, an end of a capacitor C2 is coupled to a high voltage source node, and the other end of the capacitor C2 is coupled to a control end NC_d, a capacitor C1, and a first end of a switch SW4. In an operation of the pixel voltage adjustment circuit 1' shown in FIG. 3, a relative time sequence of control signals S1 and S2, a light emitting control signal EM, and a data signal Sdata is the same as that shown in FIG. 2. Related action details are the same as those described in the foregoing, and are not described repeatedly herein. However, in this embodiment, because coupling relationships between the capacitor C2 and other components are different from those in the embodiment shown in FIG. 1, a voltage level of the control end NC_d at a light emitting stage is a result of a voltage level of a first node NC1 and a high voltage level OVDD after voltage dividing by means of the capacitor C1 and the capacitor C2. Correspondingly a current value of a drive current iD at the light emitting stage may be represented as $$iD' = \mu_d C_{OX_d}\left(\frac{W}{L}\right)_d \left[\frac{C1}{C1 + C2} \times (Vref - Vdata)\right].$$

In this case, the value of the drive current iD' is related only to a reference voltage level Vref, a data voltage level Vdata, a capacitance value of the capacitor C1, a capacitance value of the capacitor C2, and values of the foregoing parameters about a driving switch SW_d. Therefore, in this embodiment, the current value of the drive current iD' at a light emitting stage is also related only to the foregoing constant parameters and approaches a fixed value, so that a light emitting component D stably emits light at the light emitting stage according to the stable drive current iD'.

Figure 4:
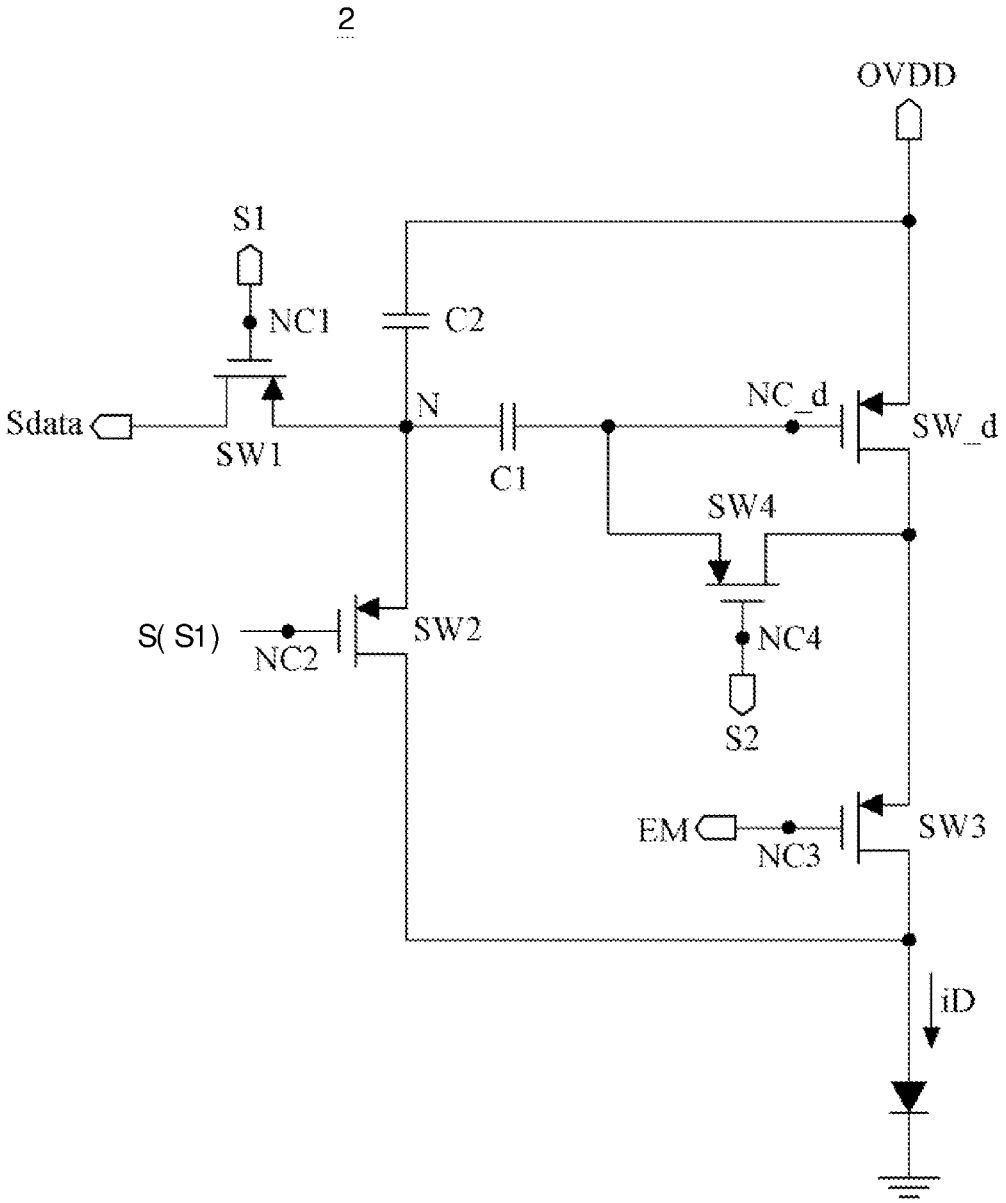
FIG. 4 is a schematic circuit diagram of a pixel voltage compensation circuit according to another embodiment of the present invention.

Further referring to FIG. 4, FIG. 4 is a schematic circuit diagram of a pixel voltage compensation circuit according to another embodiment of the present invention. In this embodiment, the control signal S is the same as the control signal S1. In an operation of the pixel voltage adjustment circuit 2 shown in FIG. 4, a relative time sequence of control signals S1 and S2, a light emitting control signal EM, and a data signal Sdata is the same as that shown in FIG. 2. The different operation between the compensation circuit in FIG. 1 and FIG. 4 is the second switch SW2 is not turned on at the data writing stage in this embodiment. Another related action details are similar with those described in the foregoing, and are not described repeatedly herein.

Figure 5:
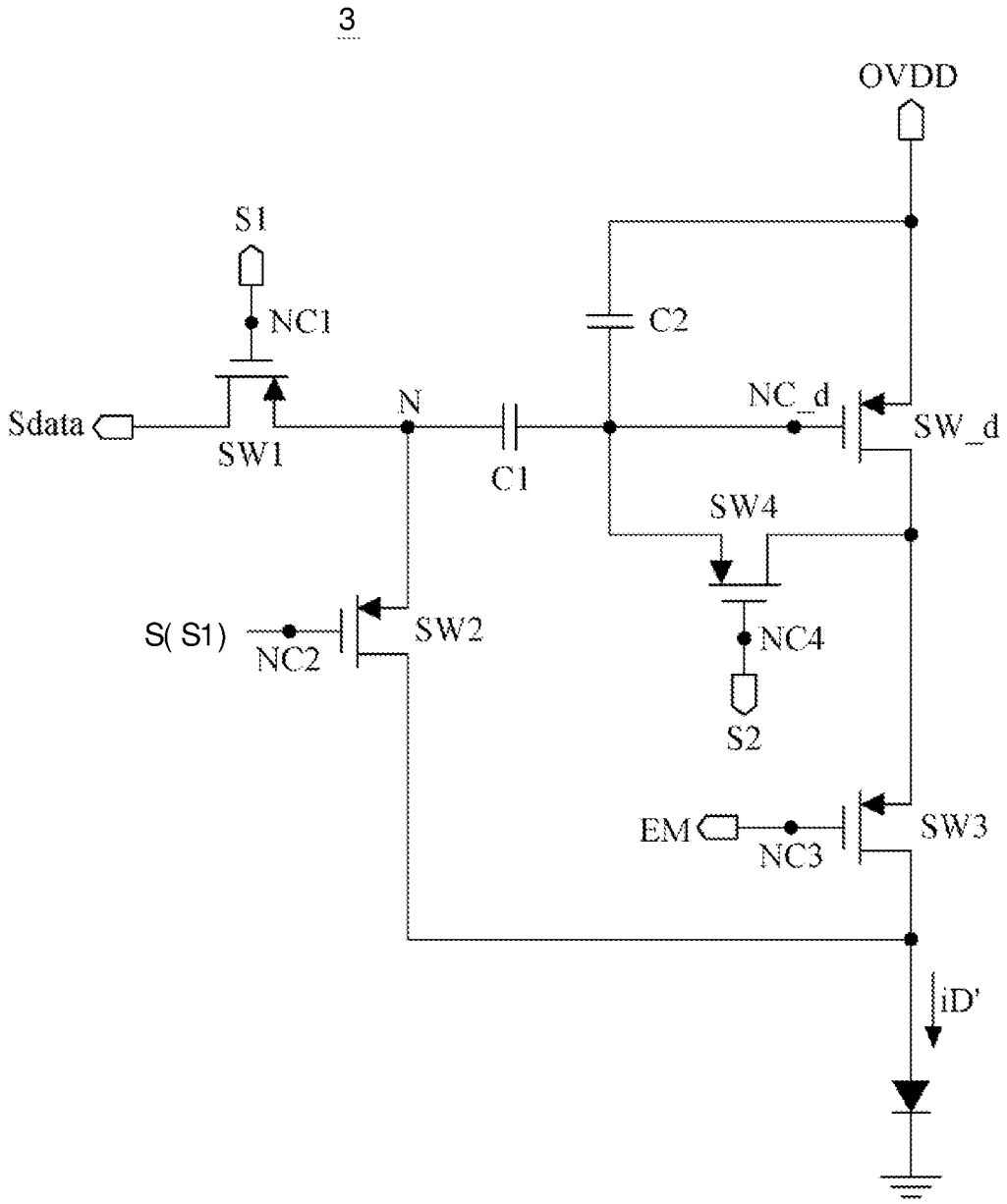
FIG. 5 is a schematic circuit diagram of a pixel voltage compensation circuit according to another embodiment of the present invention.

Further referring to FIG. 5, FIG. 5 is a schematic circuit diagram of a pixel voltage compensation circuit according to another embodiment of the present invention. In this embodiment, the control signal S is the same as the control signal S1. In an operation of the pixel voltage adjustment circuit 3 shown in FIG. 5, a relative time sequence of control signals S1 and S2, a light emitting control signal EM, and a data signal Sdata is the same as that shown in FIG. 2. The different operation between the compensation circuit in FIG. 3 and FIG. 5 is the second switch SW2 is not turned on at the data writing stage in this embodiment. Another related action details are similar with those described in the foregoing, and are not described repeatedly herein.

In conclusion, in the pixel voltage compensation circuit provided by the present invention, a compensation voltage value is written into a gate node of a driving switch at a compensation stage, so that in the pixel voltage compensation circuit, a gate voltage level of the driving switch is adjusted only according to a reference voltage and a data voltage at a light emitting stage. In this way, a drive current output by the driving switch at the light emitting stage is not affected by a characteristic offset of a transistor and therefore can remain table, and a light emitting component is driven by the stable drive current to emit light. In addition, the pixel voltage compensation circuit provided by the present invention also has a negative feedback path. Even if electric leakage of a transistor in the circuit causes a voltage of a control end of the driving switch to decrease, a control voltage offset can be compensated in real time by using the negative feedback path, so as to avoid a problem that the electric leakage of the transistor degrades quality of a displayed picture.

The foregoing embodiments are described above to disclose the present invention, but are not intended to limit the present invention. All modifications and variations made without departing from the spirit and scope of the present invention fall within the patent protection scope of the present invention. About the protection scope of the present invention, refer to an appended application scope.

What is claimed is:

1. A pixel voltage compensation circuit, comprising:

a first switch, wherein a first end of the first switch is coupled to a first node, a second end of the first switch is coupled to a data signal end, and the first switch is configured to selectively turn on according to a first control signal;

a second switch, wherein a first end of the second switch is coupled to the first node, a second end of the second switch is coupled to an anode end of a light emitting component, and the second switch is configured to selectively turn on according to a control signal;

a driving switch, wherein a first end of the driving switch is coupled to a high voltage source node;

a third switch, wherein a first end of the third switch is coupled to a second end of the driving switch, a second end of the third switch is coupled to the anode end of the light emitting component, and the third switch is configured to selectively turn on according to a light emitting control signal;

a fourth switch, wherein a first end of the fourth switch is coupled to a control end of the driving switch, a second end of the fourth switch is coupled to the second end of the driving switch, and the fourth switch is configured to selectively turn on according to a second control signal, wherein the control signal is the same as the second control signal;

a first capacitor, coupled between the control end of the driving switch and the first node; and a second capacitor, coupled between the high voltage source node and the first node, wherein at a reset stage, the first switch, the second switch, the third switch, and the fourth switch are turned on, the data signal end is configured to receive a data signal, and a voltage level of the data signal is adjusted to a reference voltage level at the reset stage.

2. The pixel voltage compensation circuit according to claim 1, wherein at a compensation stage, the first switch, the second switch, the fourth switch, and the driving switch are turned on, the third switch is not turned on, and the voltage level of the data signal is maintained at the reference voltage level at the compensation stage.

3. The pixel voltage compensation circuit according to claim 2, wherein at a data writing stage, the first switch and the driving switch are turned on, the second switch, the third switch, and the fourth switch are not turned on, and the voltage level of the data signal is adjusted to a data voltage level at the data writing stage.

4. The pixel voltage compensation circuit according to claim 3, wherein at a light emitting stage, the driving switch and the third switch are turned on, the first switch, the second switch, and the fourth switch are not turned on, and the voltage level of the data signal is adjusted to the reference voltage level at the light emitting stage.

5. The pixel voltage compensation circuit according to claim 4, wherein the second capacitor is coupled to the first node, and the second capacitor is coupled to an end of the first capacitor via the first node.

6. The pixel voltage compensation circuit according to claim 5, wherein at the light emitting stage, a value of a current output by the driving switch is related only to the reference voltage level and the data voltage level.

7. The pixel voltage compensation circuit according to claim 5, wherein the second capacitor is coupled to an end, to which the control end of the driving switch is coupled, of the first capacitor.

8. The pixel voltage compensation circuit according to claim 7, wherein at the light emitting stage, a value of a current output by the driving switch is related only to the reference voltage level, the data voltage level, a capacitance value of the first capacitor, and a capacitance value of the second capacitor.

9. A pixel voltage compensation circuit, comprising:

a first switch, wherein a first end of the first switch is coupled to a first node, a second end of the first switch is coupled to a data signal end, and the first switch is configured to selectively turn on according to a first control signal;

a second switch, wherein a first end of the second switch is coupled to the first node, a second end of the second switch is coupled to an anode end of a light emitting component, and the second switch is configured to selectively turn on according to a control signal, wherein the control signal is the same as the first control signal;

a driving switch, wherein a first end of the driving switch is coupled to a high voltage source node;

a third switch, wherein a first end of the third switch is coupled to a second end of the driving switch, a second end of the third switch is coupled to the anode end of the light emitting component, and the third switch is configured to selectively turn on according to a light emitting control signal;

a fourth switch, wherein a first end of the fourth switch is coupled to a control end of the driving switch, a second end of the fourth switch is coupled to the second end of the driving switch, and the fourth switch is configured to selectively turn on according to a second control signal;

a first capacitor, coupled between the control end of the driving switch and the first node; and a second capacitor, coupled between the high voltage source node and the first node, wherein at a reset stage, the first switch, the second switch, the third switch, and the fourth switch are turned on, the data signal end is configured to receive a data signal, and a voltage level of the data signal is adjusted to a reference voltage level at the reset stage.

10. The pixel voltage compensation circuit according to claim 9, wherein at a compensation stage, the first switch, the second switch, the fourth switch, and the driving switch are turned on, the third switch is not turned on, and the voltage level of the data signal is maintained at the reference voltage level at the compensation stage.

11. The pixel voltage compensation circuit according to claim 10, wherein at a data writing stage, the first switch and the driving switch are turned on, the second switch, the third switch, and the fourth switch are not turned on, and the voltage level of the data signal is adjusted to a data voltage level at the data writing stage.

12. The pixel voltage compensation circuit according to claim 11, wherein at a light emitting stage, the driving switch and the third switch are turned on, the first switch, the second switch, and the fourth switch are not turned on, and the voltage level of the data signal is adjusted to the reference voltage level at the light emitting stage.

13. The pixel voltage compensation circuit according to claim 12, wherein the second capacitor is coupled to the first node, and the second capacitor is coupled to an end of the first capacitor via the first node.

14. The pixel voltage compensation circuit according to claim 13, wherein at the light emitting stage, a value of a current output by the driving switch is related only to the reference voltage level and the data voltage level.

15. The pixel voltage compensation circuit according to claim 13, wherein the second capacitor is coupled to an end, to which the control end of the driving switch is coupled, of the first capacitor.

16. The pixel voltage compensation circuit according to claim 15, wherein at the light emitting stage, a value of a current output by the driving switch is related only to the reference voltage level, the data voltage level, a capacitance value of the first capacitor, and a capacitance value of the second capacitor.

17. A pixel voltage compensation circuit, comprising:

a first switch, wherein a first end of the first switch is coupled to a first node, and a second end of the first switch is coupled to a data signal end;

a second switch, wherein a first end of the second switch is directly connect to the first node, and a second end of the second switch is coupled to an anode end of a light emitting component;

a driving switch, wherein a first end of the driving switch is coupled to a high voltage source node;

a third switch, wherein a first end of the third switch is coupled to a second end of the driving switch, and a second end of the third switch is coupled to the anode end of the light emitting component;

a fourth switch, wherein a first end of the fourth switch is coupled to a control end of the driving switch, and a second end of the fourth switch is coupled to the second end of the driving switch;

a first capacitor, coupled between the control end of the driving switch and the first node; and a second capacitor, coupled between the high voltage source node and an end of the first capacitor.

* * * * *